US005251759A

United States Patent [19]

Gannon et al.

[11] Patent Number: 5,251,759

[45] Date of Patent: Oct. 12, 1993

[54] GIFT PACKAGING AND WRAPPING ENSEMBLE

[76] Inventors: James M. Gannon; Germaine A. Gannon, both of 21 W. 542 22nd St., Glen Ellyn, Ill. 60137

[21] Appl. No.: 36,483

[22] Filed: Mar. 24, 1993

[51] Int. Cl.[5] ..... B65D 71/00

[52] U.S. Cl. ..... 206/575; 206/232; 229/87.19

[58] Field of Search ..... 206/223, 224, 232, 575; 229/87.19, 923

[56] References Cited

U.S. PATENT DOCUMENTS

| | | | |
|---|---|---|---|
| 2,623,687 | 12/1952 | Williams | 229/87.19 |
| 2,808,194 | 10/1957 | Dols | 229/87.19 |
| 3,236,368 | 2/1966 | Eisen | 206/232 |
| 3,307,686 | 3/1967 | Brecher | 206/232 |
| 3,355,092 | 11/1967 | LePain | 229/87.19 |
| 3,391,856 | 7/1968 | Siegler | 229/87.19 |
| 3,677,399 | 7/1972 | Tatar | 206/232 |
| 3,790,069 | 2/1974 | Straccamore | 229/923 |
| 3,840,113 | 10/1974 | Bartleson | 206/575 |
| 4,434,889 | 3/1984 | Fery | 206/232 |
| 4,566,592 | 1/1986 | Klukos | 206/232 |
| 4,567,982 | 2/1986 | Fery | 206/232 |
| 5,001,853 | 3/1991 | Odien | 206/575 |
| 5,060,793 | 10/1991 | Hyun et al. | 206/232 |
| 5,129,522 | 7/1992 | Druskoczi | 206/575 |

*Primary Examiner*—David T. Fidei

*Attorney, Agent, or Firm*—Trexler, Bushnell, Giangiorgi & Blackstone, Ltd.

[57] ABSTRACT

A gift wrapping and packaging combination including a stiff backing member, a collapsible gift box, interior wrapping paper, exterior decorative wrapping paper, a greeting card and trimming material held together in kit fashion by a transparent plastic sheeting material heat shrunk over the above-mentioned components and shaped by said backing member. The gift wrapping and packaging ensemble can be shipped and sold in substantially flat form wherein the packaging and wrapping materials can be easily viewed through the transparent sheeting material by a prospective customer. The backing member serves not only to support and mount the ensemble elements, but also protects the ensemble during shipping in combination with other products.

7 Claims, 2 Drawing Sheets

GIFT PACKAGING AND WRAPPING ENSEMBLE

BACKGROUND OF THE INVENTION

In general, this invention relates to packaging and wrapping material for gift merchandise. More specifically, the present invention relates to a unique ensemble of such materials which provides all of the elements necessary for quickly packaging and wrapping a gift in one convenient kit.

In the past, several attempts have been made at minimizing the time and effort required to obtain packaging and wrapping material for gifts. U.S. Pat. No. 3,790,069, for example, discloses a gift box which has pre-cut decorative wrapping paper already affixed to the exterior of the gift box with adhesive lines located at predetermined positions. Major portions of the wrapping paper (including those portions intended to cover the sides of the box), however, are left unsecured to give "the appearance or simulation of having been hand-wrapped with a separate unattached sheet of wrapping paper."

Another example is seen in U.S. Pat. No. 2,808,194 which discloses a machine-wrapped container having a separate transparent outer covering (for carrying label information) which can be removed after purchase, thus resulting in a fully-wrapped package in gift form. The container disclosed in the '194 patent, however, is constructed prior to being machine-wrapped, which makes shipping of empty containers impractical. Moreover, the "machine-wrapped" look may be considered unattractive and impersonal under many circumstances.

Still other attempts at simplifying the gift packaging and wrapping task are presented in U.S. Pat. Nos. 3,355,092 and 3,391,856, but nowhere in the prior art is shown a device that combines all the necessary elements for packaging and wrapping a gift in a quick and efficient manner, yet can be distributed and marketed in an effective and efficient manner, and which results in a gift which has a "hand-wrapped" appearance when completed.

OBJECTS AND SUMMARY OF THE INVENTION

It is a general objective to provide a convenient and efficient gift packaging and wrapping ensemble.

It is a more specific objective to provide a gift packaging and wrapping ensemble which includes a gift box, interior wrapping material, decorative exterior wrapping material, a greeting card and trimming material, all combined and held together in an attractive and convenient kit.

It is an even more specific objective to provide a stiff backing member to protect the gift box, wrapping materials, card and trimming material and simultaneously shape and support a transparent sheet material used to enclose and display the ensemble.

Other objects and advantages of the invention will become apparent upon reading the following detailed description and upon reference to the drawings. Throughout the description, like referenced numerals refer to like parts.

Summarily stated, the present invention comprises a gift packaging and wrapping ensemble including the combination of a backing member of generally rigid material to provide support and protection for the ensemble, a collapsible, constructible gift box for packaging a gift, the box being collapsed upon the backing member in partially overlying relationship therewith, a first wrapping material for partially surrounding the gift merchandise when it has been positioned inside the gift box, and at least partially overlying the gift box when in collapsed form, a second wrapping material displaying a colorful design and for at least partially surrounding the fully constructed gift box, said second wrapping material at least partially overlying the first wrapping material when the gift box is in collapsed form, a gift card for bearing a greeting overlying the backing member and being at least partially unobstructed by the gift box and the first and second wrapping materials, trimming material for decorating the gift box at least partially surrounding the collapsed box, and being at least partially unobstructed by the gift box, said first and second wrapping materials, and the gift card, and a transparent sheeting material substantially surrounding and retaining the above-stated components for shipping and merchandising.

BRIEF DESCRIPTION OF THE DRAWINGS

The features of the present invention which are believed to be novel are set forth with particularity in the appended claims. The organization and manner of operation of the invention, together with further objects and advantages thereof, may be best understood by reference to the following descriptions taken in connection with the accompanying drawings, in which:

DETAILED DESCRIPTION OF THE PREFERRED EMBODIMENT

While the invention will be described in connection with a preferred embodiment, it should be understood that it is not intended to limit the invention to that embodiment. On the contrary, it is intended to cover all alternatives, modifications and equivalents as may be included within the spirit and scope of the invention.

Figure 1:
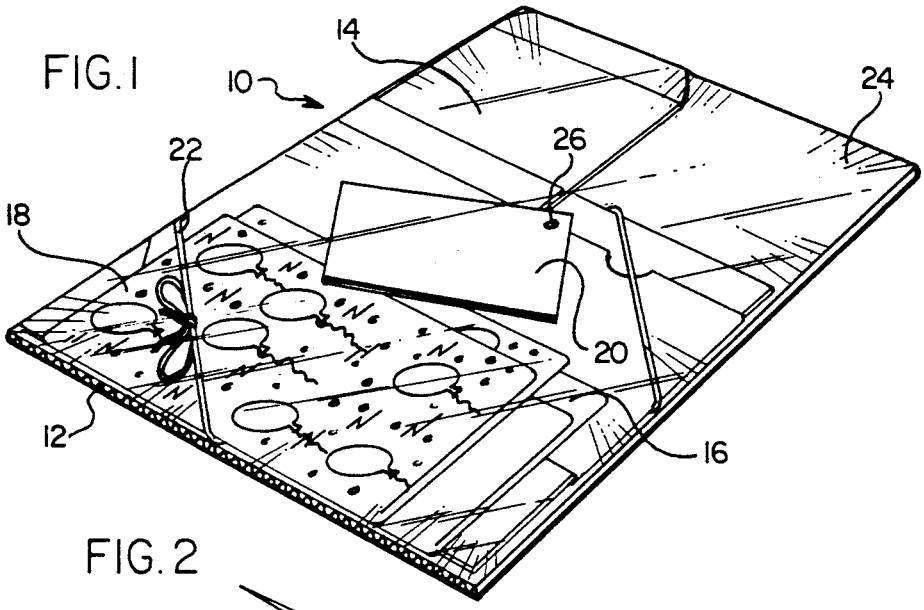
FIG. 1 is a perspective view of one embodiment of the gift packaging and wrapping ensemble of the present invention.

FIG. 1 illustrates a gift packaging and wrapping ensemble 10 in a form ready for shipping and sale. The ensemble 10 includes a backing member 12, a gift carton or box 14, interior wrapping material 16, decorative exterior wrapping material 18, a greeting card 20 and trimming material 22, such as a stretch cord, as illustrated. Finally, the ensemble 10 also includes a transparent sheet material 24 tightly surrounding the above-described components and serving to hold the ensemble 10 together, and display the contents to a potential purchaser.

The backing member 12 is preferably constructed of corrugated cardboard or some other relatively stiff, rigid material such that, in addition to serving as a mounting sheet, it also provides protection for the other elements of the ensemble 10. If, for example, the ensemble 10 is shipped in a carton which also includes gift merchandise intended to be packed and presented in the ensemble, the rigid backing member 12 can serve to protect the ensemble 10 from accidental puncture by the gift merchandise or other material with which it is shipped.

The rigidity of the backing member 12 also serves to provide the support and symmetry necessary to accomplish the preferred method of encapsulating the ensemble 10. That is, the transparent sheeting material 24 ideally is a thin, tough plastic film commonly known as "shrink-wrap" which is thermally constricted, or shrunk, over the remaining contents of the ensemble 10 and simultaneously supported and shaped by the backing member 10, as shown.

Figure 2:
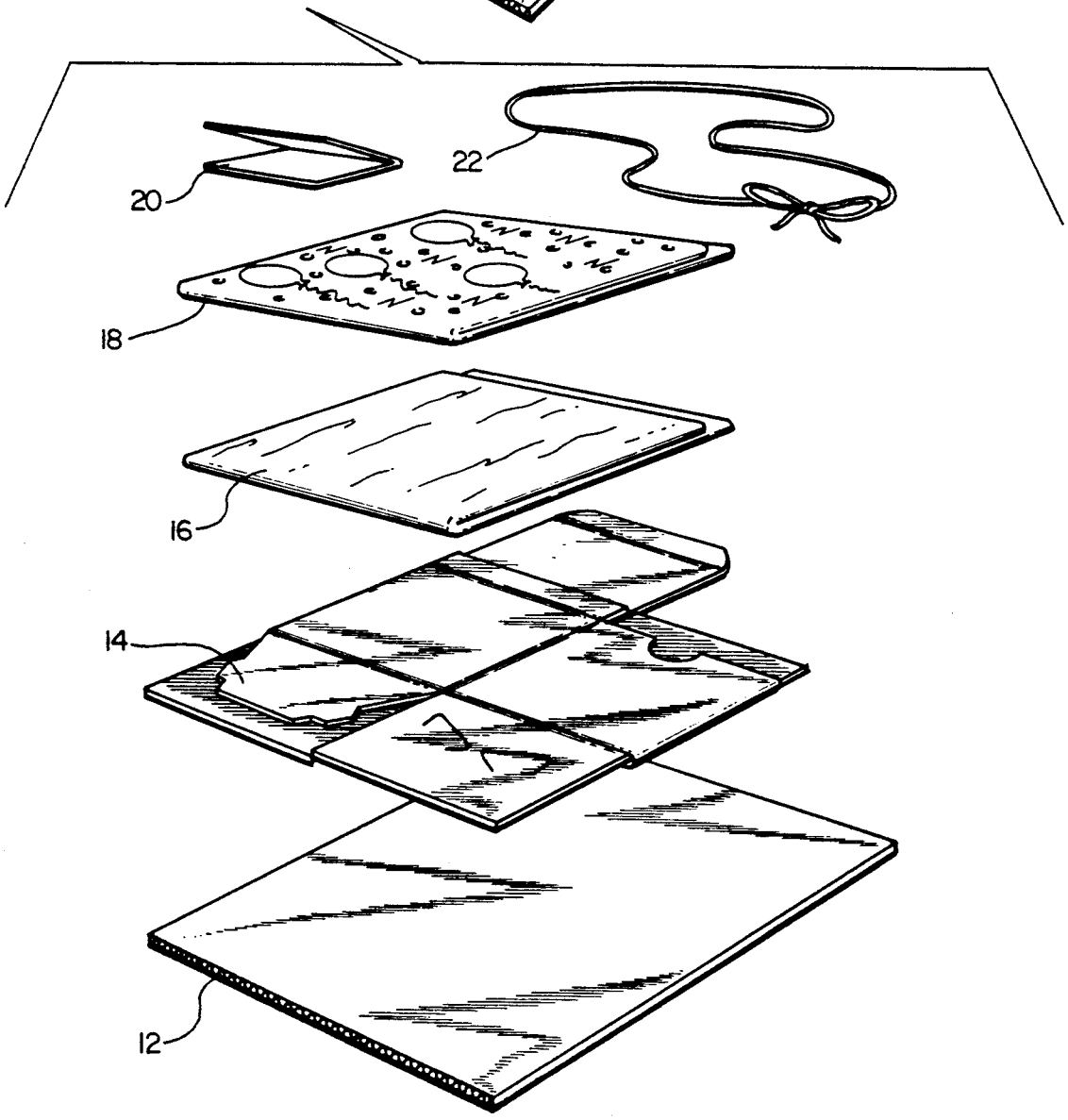
FIG. 2 is an exploded view of the various components of the invention shown in FIG. 1, excluding the transparent sheeting material utilized to enclose the ensemble.

Now turning to FIG. 2, the various components of the ensemble 10 are shown in exploded form to illustrate the preferred arrangement thereof. The backing member 12 is shown to be the bottom-most member upon which the gift box 14 is overlaid. The gift box should be of the type which is easily collapsible to lay relatively flat, and similarly, easily constructible into a suitable container to temporarily house a gift item. Such a box 14 is shown in collapsed form in FIG. 2.

Next in the sequence is the interior wrapping material 16 which, preferably, is some form of thin gauzy paper usually referred to as "tissue-paper" and commonly used to surround and protect a gift item within a gift box 14. It should be noted that in the fully-assembled ensemble 10, the interior wrapping material 16 can either be folded to lie on top of the gift box 14 as illustrated, or be arranged to partially surround the gift box 14 in a wrap-around fashion. In either case, the gift box 14 should remain partially exposed.

Following the interior wrapping material 16 is placed an exterior wrapping material 18. Like the relationship described above between the interior wrapping material 16 and the gift box 14, the exterior wrapping material 18 can either be folded and overlie the interior wrapping material 16 as illustrated, or be arranged to partially fold-around the interior wrapping material 16, and/or the gift box 14 without departing from the scope of the invention.

Again, however, it is preferred that in the completed ensemble 10, both the interior wrapping material 16 and the gift box 14 remain at least partially unobstructed by the exterior wrapping material 18.

It is further contemplated that the exterior wrapping material 18 can be of a variety of ornamental and decorative designs which are commonly available as gift wrapping paper. As illustrated, for example, balloons might be displayed. Moreover, it may be commercially advantageous to color coordinate the exterior wrapping material 18 with the interior wrapping material 16, alone, or in combination with the gift box 14.

Next, a greeting card 20 and trimming material 22 are provided preferably as shown, or otherwise visible, at least in part, without significantly obstructing the components mentioned above. The trimming material 22 can take several forms, the stretch cord ribbon illustrated being just one example thereof. Flat ribbon fabric or the equivalent might also be provided. Similarly, a number of different types of gift cards 20 having generally the same characteristics may be substituted.

With reference back to FIG. 1, it should now be clear that once the various elements discussed have been arranged in the manner described, the transparent sheet material 24 is placed over the elements and thermally constricted thereupon in a process commonly referred to as "shrink-wrapping", such process being commonly known to one of ordinary skill in the art and therefore not discussed in detail here. It is again noted that during the "shrink-wrapping" process, the backing member 12 functions to provide support, shape and symmetry which causes the finished ensemble 10 to be attractive and effective merchandising tool.

Figure 3:
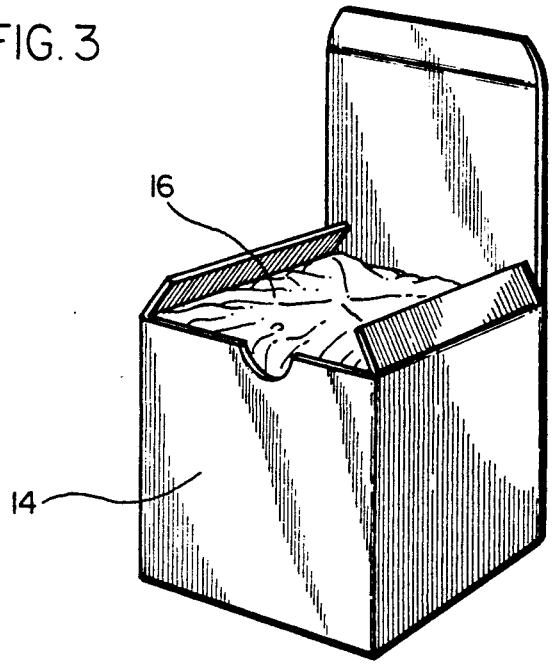
FIG. 3 illustrates the gift box component of the present invention in fully-constructed form with its top open exposing the interior wrapping material component of the invention.
Figure 4:
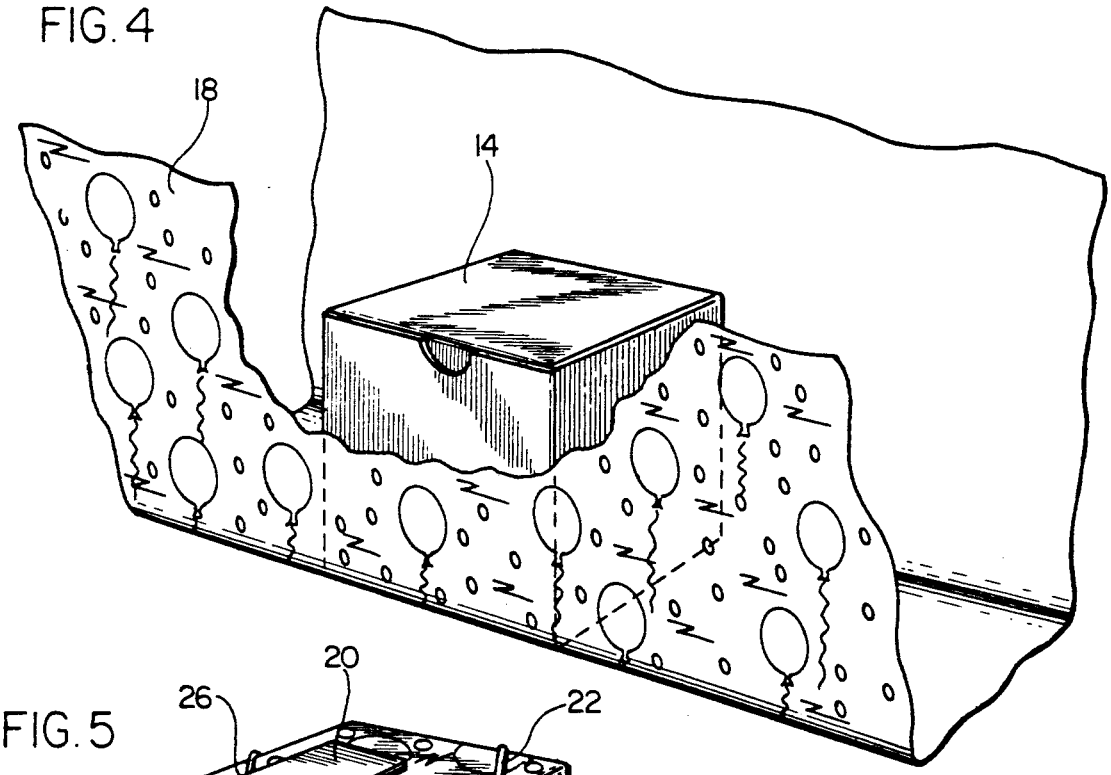
FIG. 4 illustrates the gift box component having the exterior wrapping material being placed thereon.
Figure 5:
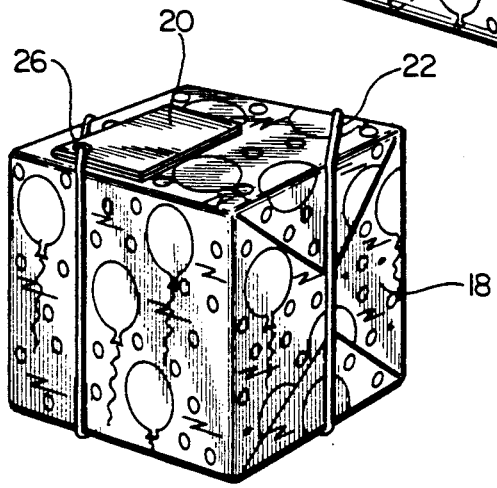
FIG. 5 is another perspective view of the invention after the ensemble has been utilized to completely package and wrap an item of gift merchandise.

The ensemble can be displayed commercially in a variety of formats to perspective purchasers who can freely view the components thereof, and select the format and color combination that best suits their individual needs. As depicted in FIGS. 3–5, the ensemble can easily be opened and used to package and wrap a gift in a quick and convenient manner. In the illustrated ensemble 10, the greeting card 14 is also provided with a hole 26 through which cord 22 can be threaded to protect against the greeting card 14 being separated from the gift.

In addition to the trimming material 22, supplemental means for securing the exterior wrapping paper 18, such as adhesive tape or glue may also be provided.

The invention is claimed as follows:

1. A gift packaging and wrapping ensemble comprising, in combination, the following elements:

a. a backing member of generally rigid material providing support and protection for said gift ensemble;

b. a collapsible, constructible gift box for packaging gift merchandise, said box being collapsed upon said backing member in partially overlying relationship therewith;

c. a first wrapping material for at least partially surrounding said gift merchandise when positioned inside said gift box in its fully constructed form, said first wrapping material being generally thin and at least partially overlying said collapsed gift box;

d. second wrapping material displaying a colorful design for at least partially surrounding said fully constructed gift box, and at least partially overlying said first wrapping material overlying said collapsed gift box;

e. a gift card for bearing a greeting overlying said backing member and being at least partially unobstructed by said gift box and said first and second wrapping materials;

f. trimming material for decorating said gift box at least partially surrounding said collapsed gift box and being at least partially unobstructed by said gift box, said first and second wrapping materials, and said gift card, and;

g. a transparent sheeting material for substantially surrounding and retaining said gift ensemble in a kit;

h. wherein, at least some portion of said gift box, said first and second wrapping materials, said gift card and said trimming material are fully exposed and visible through said transparent sheeting material for commercially displaying and promoting said gift ensemble.

2. The gift ensemble recited in claim 1, wherein said backing member is constructed of corrugated cardboard of sufficient thickness to protect said gift ensemble from puncture damage.

3. The gift ensemble as recited in claim 1, wherein said transparent sheet material comprises a tough clear plastic film that is heat shrunk to surround said gift ensemble, and wherein said backing member comprises a material of sufficient rigidity to support, and provide symmetry for said heat shrunk plastic film, thereby minimizing element movement and increasing the attractiveness and salability of the gift ensemble.

4. The gift ensemble as recited in claim 1, wherein the total thickness of said combined packing member, gift box, first and second wrapping materials, gift card, trimming material and transparent sheet material is less than approximately ⅜".

5. The gift ensemble as recited in claim 1, wherein at least two of said elements are color coordinated and arranged to suggest the appearance of the completed gift after packing and wrapping.

6. A packing and wrapping kit for gift merchandise comprising, in combination, the components of:

a. a backing member for supporting and protecting said kit;

b. a preformed, collapsible, erectable gift box;

c. interior wrapping material for at least partially surrounding a gift placed in said gift box;

d. exterior wrapping material for at least partially surrounding said gift box after being erected;

e. a greeting card for personalizing said packing and wrapping kit;

f. trimming means for further decorating said erected gift box, and;

g. content identification means substantially including material for enclosing said packing and wrapping kit components such that said components are easily identifiable to a prospective purchaser of said gift packing and wrapping kit.

7. A gift packing and wrapping kit as recited in claim 6, wherein the components are at least partially overlying one another with the lower most component being the backing member, on top of which is located the gift box, on top of which is located the interior wrapping paper, on top of which is located the exterior wrapping paper, on top of which is located the gift card, on top of which is located the trimming material, on top of which is located the content identification means in the form of heat shrunk plastic sheeting which substantially completely surrounds the backing member and the other components placed thereon.

* * * * *